United States Patent [19]

Yoshizawa

[11] Patent Number: 4,693,612

[45] Date of Patent: Sep. 15, 1987

[54] ALARM MECHANISM

[75] Inventor: Keiichi Yoshizawa, Tokyo, Japan

[73] Assignee: Seikosha Co., Ltd., Tokyo, Japan

[21] Appl. No.: 914,127

[22] Filed: Oct. 1, 1986

[30] Foreign Application Priority Data

Dec. 27, 1985 [JP] Japan ..... 60-298713

[51] Int. Cl.[4] ..... G04B 23/02

[52] U.S. Cl. ..... 368/74; 368/238; 368/262; 368/269

[58] Field of Search ..... 368/74, 258, 259, 261–271, 368/243, 244, 249, 253, 254, 228, 238

[56] References Cited

U.S. PATENT DOCUMENTS 4,452,537 6/1984 Fukuda et al. ..... 368/269

4,460,280 7/1984 Tomonori ..... 368/74

*Primary Examiner*—Bernard Roskoski

*Attorney, Agent, or Firm*—Bruce L. Adams; Van C. Wilks

[57] ABSTRACT

An alarm mechanism for an alarm clock has an alarm hand and an hour hand mounted coaxially with respect to each other, and slideably contacting hub portions of the alarm hand and the hour hand are formed with cam grooves and cam pawls respectively. The cam grooves and cam pawls are positioned with the same positional relationship with respect to the hub portions of the alarm hand and hour hand so that at a preselected alarm time, the cam grooves and cam pawls cooperatingly engage one another to thereby actuate a mechanism to sound the alarm of the alarm clock. In attaching the hands to the clock during assembly, it is possible to attach the alarm hand and the hour hand onto respective shafts at any random angular position without having to pay special attention to the respective positional relationships of the two hands. The hands can be formed in multiple parts and molded together.

10 Claims, 15 Drawing Figures

ALARM MECHANISM

BACKGROUND OF THE INVENTION

The present invention relates to an alarm mechanism in an alarm clock.

Conventionally, an alarm mechanism has been arranged such that cam grooves are formed in an alarm wheel on which an alarm hand is attached, and cam pawls are projectingly provided on a gear of an hour wheel on which an hour hand is attached, so that when a setting alarm time is reached, the cam grooves of the alarm wheel are made to engage with the cam pawls of the gear of the hour hand by the spring force of a plate spring elastically abutting against the alarm wheel, thereby causing an alarm sound.

During the process of assembling a clock, the work of attaching hands in the prior art clock having an alarm mechanism has been performed through the steps that the cam grooves of the alarm wheel are made to engage with the cam pawls of an hour wheel by rotating the hands, and the alarm and hour hands are attached onto the alarm and hour wheels respectively with predetermined positional relationships while holding the state of above-mentioned engagement between the cam grooves and cam pawls. In addition to the foregoing steps, it has been required to perform adjustment work by rotating the hands. This is because it is necessary to perform not only the positional adjustment between the cam grooves of the alarm wheel and the cam pawls of the hour wheel but the positional adjustment among the cams and the alarm and hour hands. However, in the actual circumstances, the operation of adjusting the position of an alarm hand is troublesome to causes an obstacle in the process of assembling a clock. Further, in the repairing of a clock, if an alarm hand or an hour hand comes off from an alarm wheel pipe or an hour wheel pipe, the reattachment work is very difficult in that one must perform the position adjustment in the same manner as described above.

An object of the present invention is to provide an alarm mechanism in which the foregoing positional adjusting operation can be extremely easily carried out and in which the accuracy in alarm setting is high.

The present invention is characterized in that in an alarm hand and an hour hand which are provided coaxially with each other, in contacting portions between respective hub portions of the alarm and hour hands, cam grooves and cam pawls are respectively formed on one and the other of the respective hub portions, and the cam grooves and the cam pawls are provided with the same positional relationship with each other with respect to respective hand portions of the alarm and hour hands.

Accordingly, unlike the prior art in performing the work of attaching the hands of a clock having an alarm mechanism, according to the present invention, it is possible to attach an alarm hand and an hour hand onto respective shafts at any random position through a press-in mechanism or the like, without having to pay attention to the respective positional relationships of the two hands. When a setting alarm time is reached, the alarm and hour hands cooperate such that the cam grooves and the cam pawls are made to engage with each other resulting in a displacement which causes an alarm contact to be brought in an ON state due to the displacement to thereby generate an alarm sound.

BRIEF DESCRIPTION OF THE DRAWINGS

FIGS. 10 through 13 show another embodiment, in which FIG. 10 is an enlarged plane view of the hour hand, FIG. 11 is a cross-section taken on line XI—XI of FIG. 10, FIG. 12 is an enlarged plane view of the alarm hand, and FIG. 13 is a cross-section taken on line XIII—XIII of FIG. 12.

DETAILED DESCRIPTION OF THE INVENTION

Figure 1:
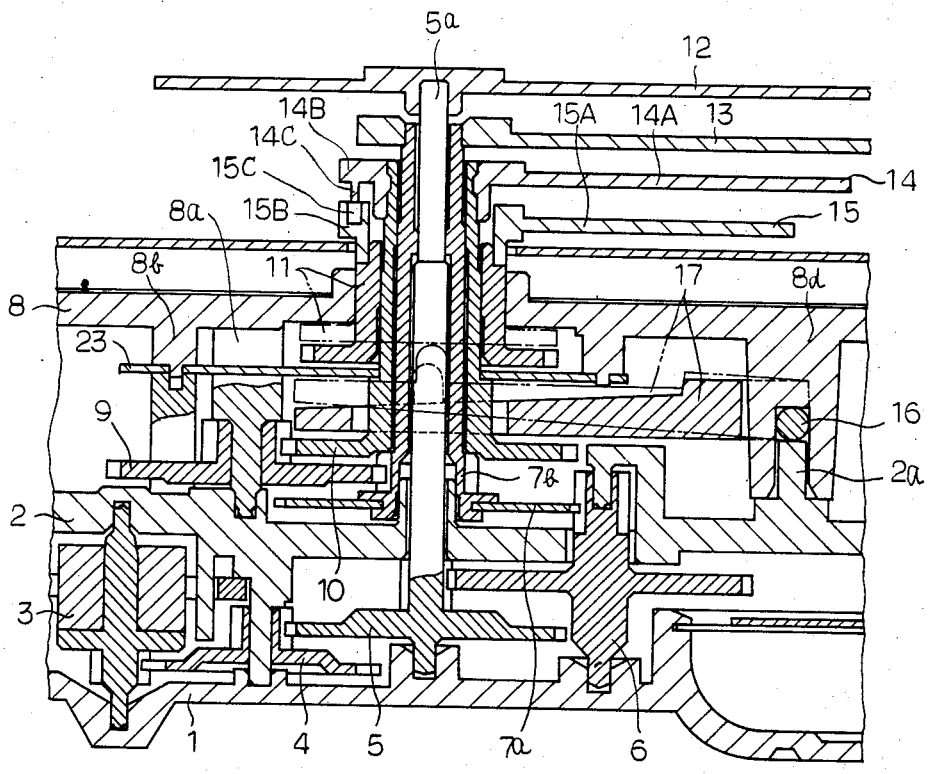
FIG. 1 is a cross-section, of an alarm clock depicting the present invention

Referring to the drawings, an embodiment according to the present invention will be described.

As shown in FIG. 1, a rotor 3 is journaled between an upper plate 1 and a middle plate 2. The rotary driving-force of the rotor 3 is transmitted through a driving wheel 4 to drive the same, and the rotary force of the second wheel 5 is in turn transmitted through an intermediate wheel 6 to a minute wheel 7*a* to drive the same. The minute wheel 7*a* is linked with a minute wheel pipe 7*b* through a slip mechanism (not shown).

Further, an intermediate wheel 9 is rotatably supported by a pillar 8*a* formed integrally on the lower plate 8 and is geared with a pinion portion of the minute wheel pipe 7*b* as well as with an hour wheel 10 to thereby transmit the rotation of the minute wheel pipe 7*b* to the hour wheel 10. The minute wheel pipe 7*b* is coaxially fitted on a shaft portion 5*a* of the second wheel 5 and the hour wheel 10 is fitted on the outer periphery of the minute wheel pipe 7*b*. A step portion of the hour wheel 10 is engaged with the periphery of a hole formed in a horizontally maintained support plate 23, so that the hour wheel is thereby limited against further movement upwards as shown in FIG. 1, thereby performing the positioning of the hour hand. The support plate 23 is held by a pillar 8*b* formed on the lower plate 8 to extend downwards therefrom.

Further, an alarm wheel 11 is coaxially rotatably fitted on the outer periphery of the shaft portion of the hour wheel 10, so that the alarm wheel 11 is movable along the outer periphery of the hour wheel shaft portion in the direction of the axis of the latter.

A second hand 12, a minute hand 13, an hour hand 14, and an alarm hand 15 are fixedly pressed onto the respective upper ends of the shaft portion 5*b* of the second wheel 5, the minute wheel pipe 7*b*, the hour wheel 10, and the alarm wheel 11, respectively.

An alarm mechanism according to the present invention is as follows.

The hour hand 14 is comprised of a hand portion 14A and a hub portion 14B which is inserted on the shaft end portion of the hour wheel 10, and the alarm hand 15 is also comprised of a hand portion 15A and a hub portion 15B which is inserted on the alarm wheel 11.

Figure 2:
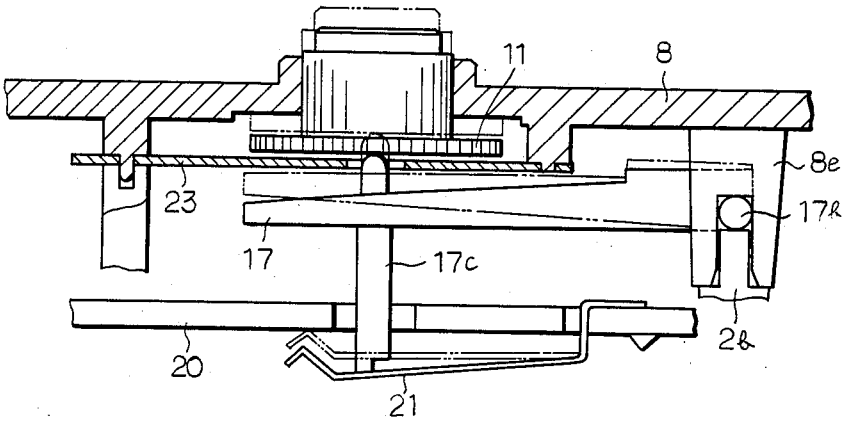
FIG. 2 is a cross section showing the constitution of the push lever thereof.
Figure 3:
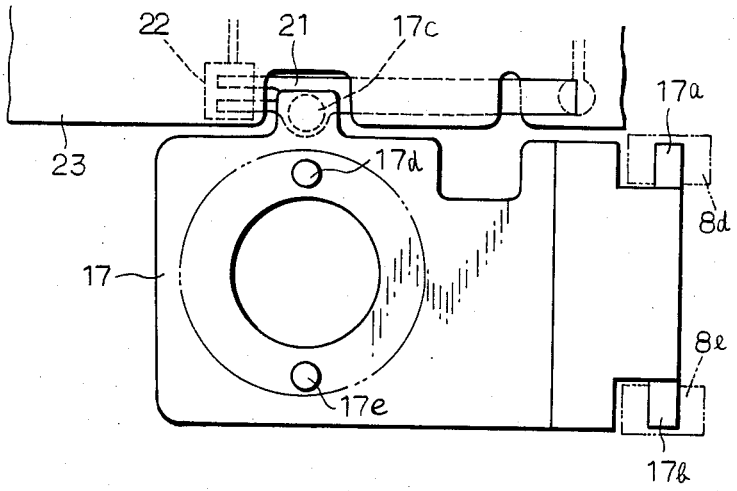
FIG. 3 is a plane view of the push lever.

Referring now to FIGS. 2 and 3, the alarm wheel 11 is shown being pushed up or raised by a push lever 17. The push lever 17 is provided with rotary shafts 17*a* and 17*b* formed respectively at the opposite end portions of the push lever at one side thereof, and the two shafts 17*a* and 17*b* are respectively swingably supported by pillars 8*d* and 8*e* projected from the lower plate 8 as well as by pillars 2*a* and 2*b* projected from the middle plate 2. A pin 17*c* depends from the push lever 17 and is urged upwards by an alarm switch lever 21 supported by a printed circuit board 20. A free end portion of the alarm switch lever 21 makes contact with and breaks contact from a contact piece 22 which is pattern-formed on the printed circuit board 20 so as to perform on/off operations of the alarm. Two pins 17*d* and 17*e* are provided which project from upwards the punch lever 17 and respectively pass through holes formed in the support plate 23 to push the alarm wheel 11 upwards. Thus, the hub portion 15B of the alarm hand 15 is urged to normally abut on the hub portion 14B of the hour hand 14.

The hub portion 14B of the hour hand 14 is provided with cam pawls 14C and 14D, and the hub portion 15B of the alarm hand 15 is provided with cam grooves 15C and 15D, the specified shapes of the cam pawls and cam grooves being as follows.

Figure 4:
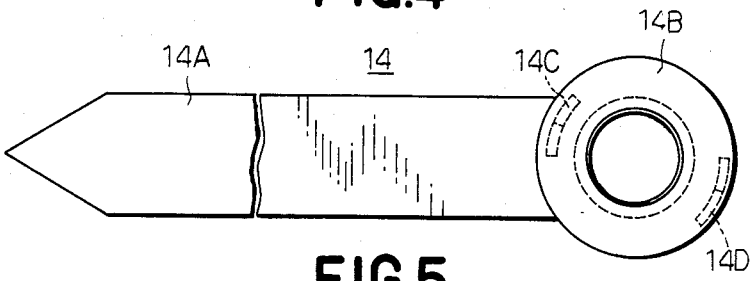
FIG. 4 is an enlarged plane view of the hour hand.
Figure 5:
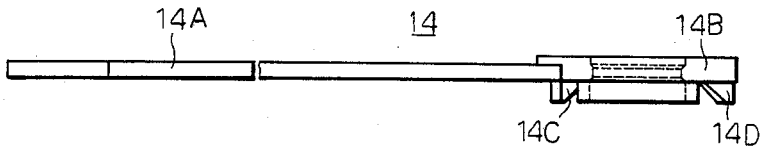
FIG. 5 is a side view of FIG. 4.

As shown in FIGS. 4 and 5, in the hour hand 14, the two cam pawls 14C and 14D are projectingly formed on the hub portion 14B on the opposite sides of and at different distances from the axis of the hub portions 14B. The front surface with respect to the direction of advancement of the clock of each of the cam pawls is slantingly formed (see FIG. 8A).

Figure 6:
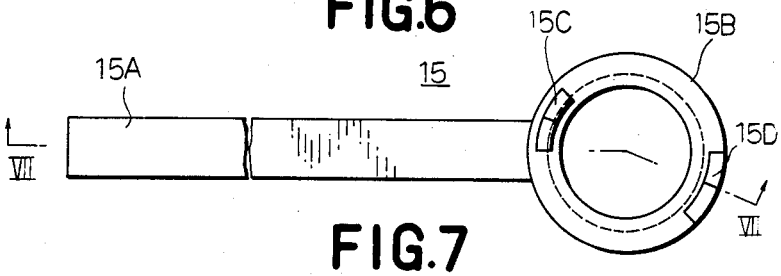
FIG. 6 is an enlarged plane view of the alarm hand.
Figure 7:
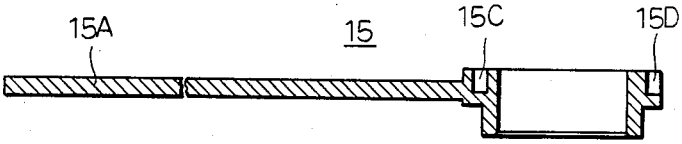
FIG. 7 is a cross-section taken on line VII—VII of FIG. 6, FIGS. 8A through 8C are enlarged cross-sections showing various states of engagement between the hour hand and the alarm hand.
Figures 8A, 8B, 8C:
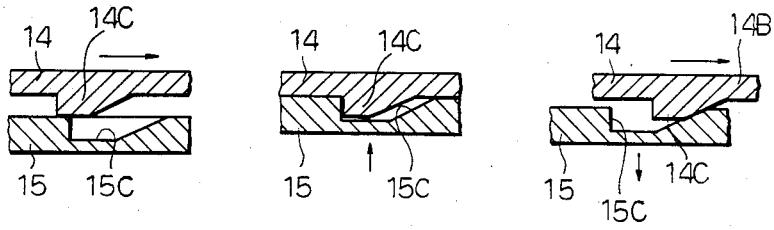

As shown in FIGS. 6 and 7, in the alarm hand 15, the cam grooves 15C and 15D are formed with a positional relationship with respect to the hand portion 15A similarly to the positional relationship between the cam pawls 14C, 14D and the hand portion 14A, the front surface of each of the cam grooves being slantingly formed (see FIG. 8A).

In attaching the hands, the alarm hand 15 is first attached on the top end portion of the shaft of the alarm wheel 11 in any orientation, and the hour hand 14 is then attached on the top end portion of the shaft of the hour wheel 10 without having to give attention to the orientation thereof. The minute hand 13 is then attached taking into consideration the positional relationship with respect to the hour wheel 10, and finally the second hand 12 is fitted to complete the work of attaching the hands.

When the set alarm time is reached, the condition of the cam pawls 14C and 14D are changed from the state of FIG. 8A to that of FIG. 8B so that the cam pawls 14C and 14D are respectively fitted in the cam grooves 15C and 15D so that the alarm switch lever 21 push up the pushes lever 17 (as shown in FIG. 2) to come into contact with the contact piece 22 to thereby provide an ON state where an alarm will sound. Thereafter, with the lapse of time, the cam pawls 14C and 14D and the cam grooves 15C and 15D respectively slide relative to each other at their slanting surfaces as shown in FIG. 8C to thereby make the alarm hand 15 recover to an initial OFF state.

Figure 9:
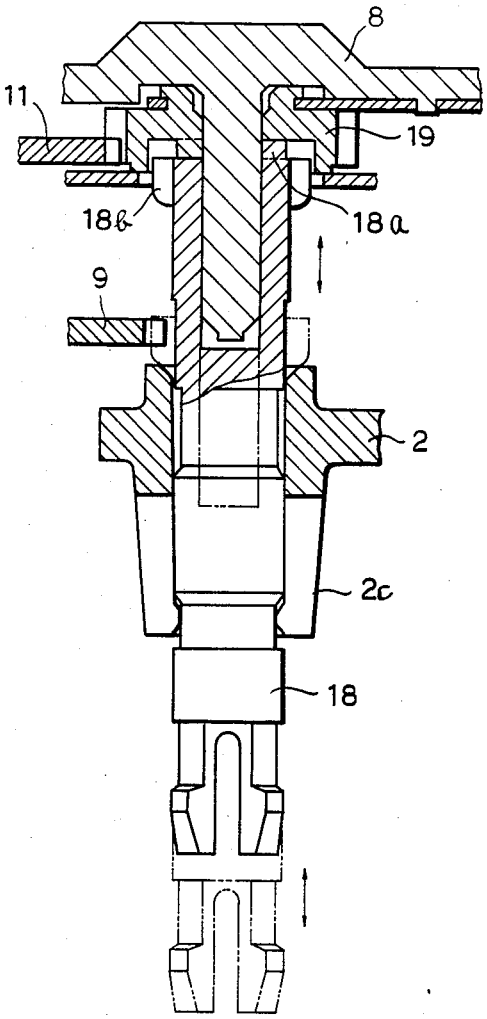
FIG. 9 is an enlarged section of a hand correcting mechanism.

FIG. 9 shows a hand correcting mechanism in which a hand correcting shaft 18 is axially slidably supported through the middle plate 2 and the lower plate 8 and the sliding stroke of the hand correcting shaft 18 is defined by a clicking arm 2*c* provided on the middle plate 2. A saw-tooth-like ratchet 18*a* is radially formed on the upper end surface of the hand correcting shaft 18, and a gear 19 is provided between the ratchet 18*a* and the lower plate 8 so as to gear at its under surface with the ratchet 18*a*. Therefore, the rotary force of the hand correcting shaft 18 in only one rotating direction thereof can be transmitted to the gear 19. The gear 19 gears with the alarm wheel 11 so that an alarm time is set by rotation of the alarm wheel. Further, if a knob (not shown) fixed on the lower end of the hand correction shaft 18 is grasped and pulled down, a toothed portion 18*b* is made to gear with the intermediate wheel 9 (see phantom lines in FIG. 9) so as to make it possible to correct the indication of time by rotating the minute hand 13 and the hour hand 14.

Next, description will be made as to another embodiment with respect to the hour hand and the alarm hand.

Figure 10:
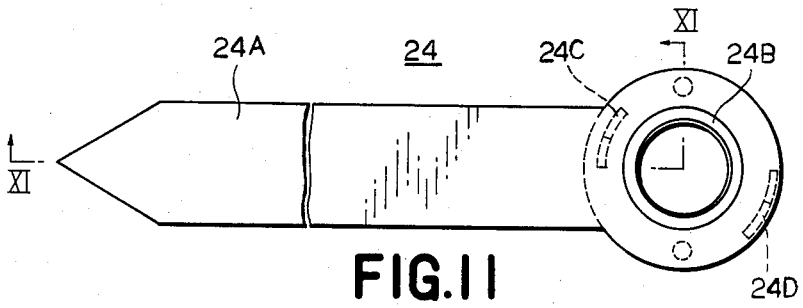
Figure 11:
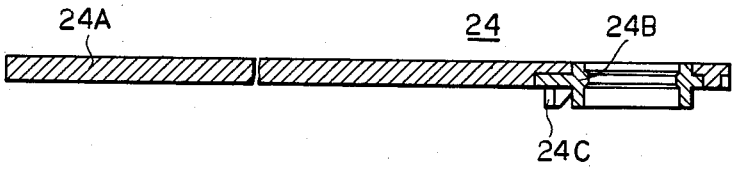

As shown in FIGS. 10 and 11, an hour hand 24 is formed by two parts, that is, a hand portion 24A and a hub portion 24B which is formed with cam pawls 24C and 24D. The hour hand 24 is molded in two colors in such a manner that the hand portion 24A and the hub portion 24B are molded with ABS resin and polycarbonate respectively. Accordingly, if the hour hand 24 is to be metal plated, only the hand portion 24A is plated while the hub portion and its cam pawls 24C and 24D are not plated, so that not only a predetermined cam function can be performed by the cam pawls, but only the hand portion 24A has a metallic color.

Figure 12:
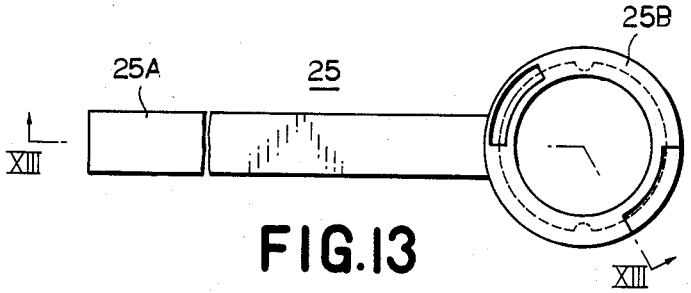
Figure 13:
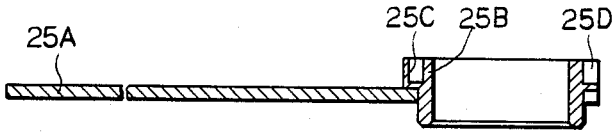

In like manner the alarm hand 25 can also be molded, in two colors, with a hand portion 25A and a hub portion 25B as shown in FIGS. 12 and 13. Cam grooves 25C and 25D formed in the hub portion are capable of engaging respectively with cam pawls 24C and 24D similarly to the previously described embodiment, and the grooves are formed with the same relationship with respect to the hand portion 25A as that in the previously described embodiment.

Having an arrangement as described above, the present invention is simple in structure, and eases the work of assembling the alarm mechanism, thereby making accuracy in alarm setting high.

What is claimed is:

1. An alarm mechanism having an alarm hand and an hour hand coaxially disposed with respect to each other, the hands having respective hand portions and slideably contacting hub portions, cam grooves and cam pawls respectively formed on one and the other of said respective hub portions, said cam grooves and said cam pawls having the same positional relationship with each other relative to the respective hand portions of said alarm and hour hands.

2. An alarm mechanism according to claim 1, inlcuding spring means for urging said alarm hand against said hour hand.

3. An alarm mechanism according to claim 1, wherein the hand and hub portions of each of said alarm and hour hands and molded in different colors.

4. An alarm mechanism for an alarm clock comprising: an alarm hand and an hour hand rotatably mounted coaxially with respect to each other, said hands having respective hub portions in slideable contact with one another; one of said hands having thereon multiple indented cam means and the other of said hands having thereon a like number of multiple projecting cam means, individual ones of said cam means on each of the respective hands being at different radial distances from their respective hub axis, all of said indented cam means and said projecting cam means cooperatingly engaging one another at a preselected alarm time to effect the sounding of an alarm.

5. An alarm mechanism according to claim 4; including means for resiliently urging said alarm hand against said hour hand.

6. An alarm mechanism according to claim 4; wherein said hour hand and said alarm hand each comprise two molded together parts, the two parts being the hand portion and the hub portion.

7. An alarm mechanism for an alarm clock comprising: an alarm hand and an hour hand mounted coaxially with respect to each other and being rotatable about a given axis, said hands having respective hub portions having opposed faces in slideable contact with one another; two cam pawls projecting outwardly from the hub portion face of one of said hands on diametrically opposite sides of and at different radial distances from said axis; and two cam grooves extending inwardly from the hub portion face of the other of said hands on diametrically opposite sides of and at different radial distances from said axis, the two cam grooves being configured to receive therein respective ones of the two cam pawls when said hour hand rotates to a predetermined position relative to said alarm hand.

8. An alarm mechanism according to claim 7; including means for sounding an alarm when said hour hand rotates to said predetermined position.

9. An alarm mechanism according to claim 7; wherein the two cam pawls are formed on the hub portion of the hour hand.

10. An alarm mechanism according to claim 7; wherein a front surface of the cam pawls with respect to the direction of advancement of the hour hand is slanted and cooperates with a corresponding slanted surface of said cam grooves to effect the sounding of an alarm at a preselected alarm time.

* * * * *